United States Patent [19]

Green

[11] 4,128,176

[45] Dec. 5, 1978

[54] DISPLAY RACK

[76] Inventor: Edward N. Green, 121 Leafmore Rd., Rome, Ga. 30161

[21] Appl. No.: 818,102

[22] Filed: Jul. 22, 1977

[51] Int. Cl.[2] ..... A47F 7/16

[52] U.S. Cl. ..... 211/45; 248/161; 248/188.7; 248/460

[58] Field of Search ..... 211/45, 182, 189, 195, 211/204, 196; 248/163–165, 188.7, 121, 161, 441 R, 460–465, 452, 150; 108/153, 154

[56] References Cited

U.S. PATENT DOCUMENTS

| | | | |
|---|---|---|---|
| 2,268,288 | 12/1941 | Kiefer | 248/460 |
| 2,596,302 | 5/1952 | Squyres | 248/465 X |
| 3,021,960 | 2/1962 | Pipe | 248/188.7 X |
| 3,662,980 | 5/1972 | Kantor et al. | 248/161 |
| 3,965,583 | 6/1976 | Price | 211/45 |

*Primary Examiner*—Roy D. Frazier
*Assistant Examiner*—Terrell P. Lewis
*Attorney, Agent, or Firm*—Beveridge, DeGrandi, Kline and Lunsford

[57] ABSTRACT

A display stand for displaying samples of carpet bound in a book format may be assembled by the user thereof and includes a generally U-shaped base member, a vertical member, a pair of leg members sloped to support the lower portion of the book and maintain the vertical member upright, and a support member adapted to receive the upper edge portion of the book wherein the carpet samples bound therein may be readily viewed by an observer.

8 Claims, 6 Drawing Figures

Fig. 6.
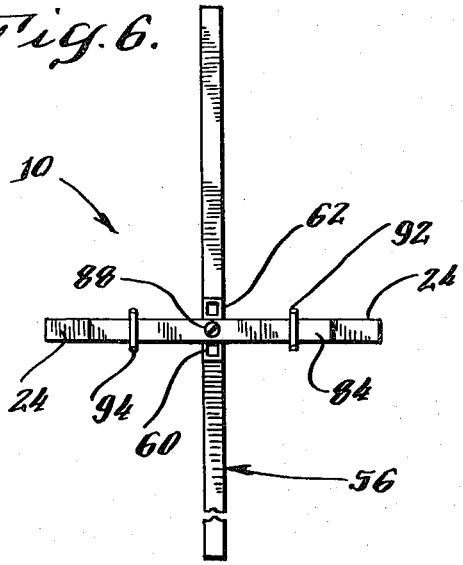
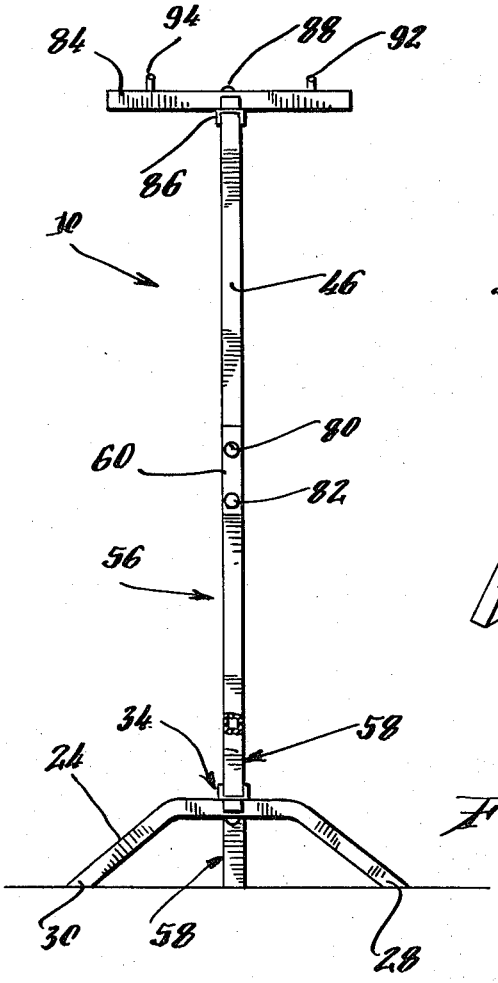
Fig. 5.
Fig. 4.
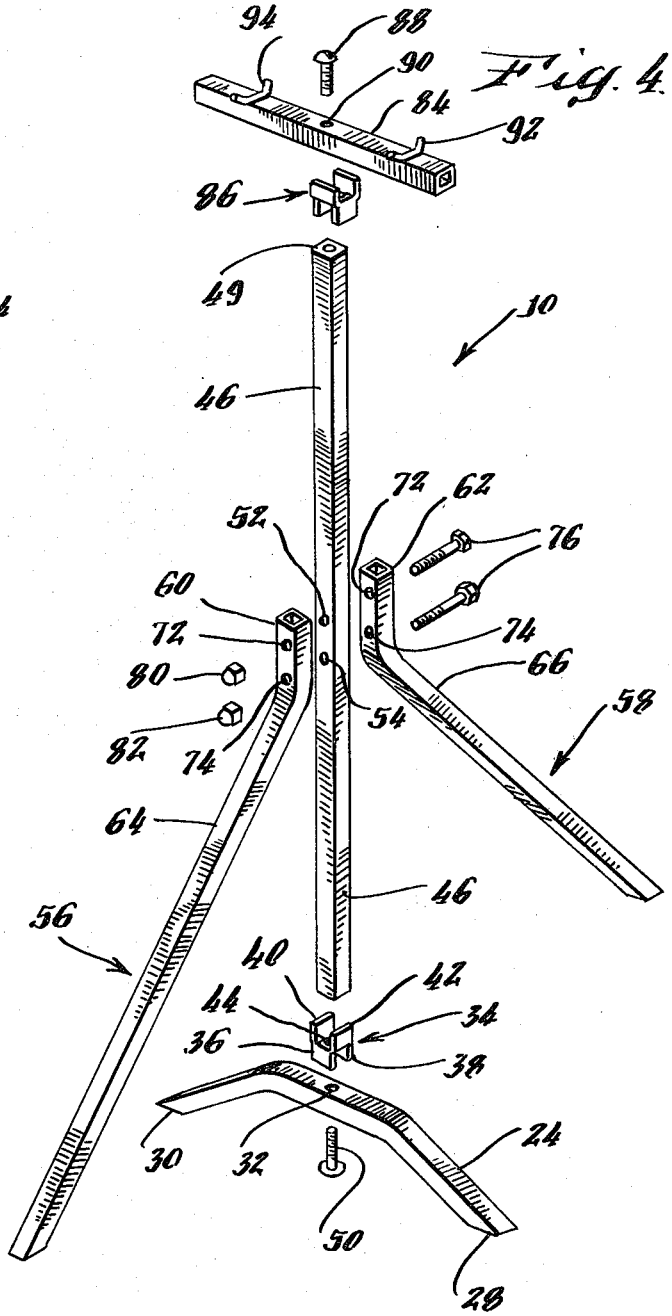

DISPLAY RACK

BACKGROUND OF THE INVENTION

The present invention relates to display stands, racks and in particular, to a display stand adapted to display carpeting samples bound in a book format.

In order to display a multiplicity of carpet designs and colors to an ultimate consumer generally sample rolls are provided and stored along the walls in a display area or showroom. This arrangement occupies large areas within a showroom and must frequently be arranged to have the sample rolls displayed conform with the actual material in stock. Thus, in order to conserve space and more readily display variations in carpeting styles and colors, a new sample technique has evolved. The present display format includes the use of carpet samples bound in a book format which may be readily mounted on a display rack. The book includes pages which may be readily updated to conform with the latest styles and material in stock. At present the display book may frequently be found hanging from a bracket affixed to a wall or pole. Alternatively, small tables with sloped sides are made available where the consumer may browse through the leaves of the book when they are placed thereon. This has become a rather tedious job for both the consumer and the salesman in attempting to display the multitude of samples which are available for review. The present invention attempts to overcome the shortcomings of the display devices used in the prior art by providing a display stand which may be assembled by the user thereof. The display stand is for displaying two books of sample carpeting simultaneously. The display rack is provided with a sloped surface which enables the carpeting to be readily viewed by an observer and eventual purchaser thereof. The present display stand may be positioned in any convenient place, occupies a minimum of space, and is readily assembled by the user thereof. Thus, as additional samples are made available the salesman may assemble additional racks so that the observer of the samples may have an opportunity of viewing a multiplicity of samples simultaneously. Therefore, it is an object of the present invention to provide a display rack or stand for displaying a plurality of carpet samples bound in a book format.

It is a further object of the present invention to provide a display stand for simultaneously displaying a plurality of carpet samples bound in a pair of sample books.

It is a further object of the present invention to provide a display stand for displaying samples of carpet bound in a book format which is inexpensive, easy to assemble, and requires a minimum of floor space.

The foregoing and other objects and advantages will appear from the description to follow. In the description, reference is made to the accompanying drawings which form a part thereof, and in which is shown by way of illustration a specific embodiment for practicing the invention. This embodiment will be described in sufficient detail to enable those skilled in the art to practice the invention, and it is to be understood that other embodiments may be utilized and that structural changes may be made without departing from the spirit and scope of the invention. The following detailed description is, therefore, not to be taken in a limiting sense, and the scope of the invention is best defined by the appended claims.

SUMMARY OF THE INVENTION

A display stand for displaying samples of carpet bound in a book format, according to the principles of the present invention comprises, a generally U-shaped base member having its open end disposed in a downwardly direction for contact with a flat surface, a vertical member having its lower end affixed to the central portion of the U-shaped base member, a pair of leg members affixed to the vertical member and extending outwardly therefrom in a plane intersecting a plane formed by the vertical member and the base member at essentially a right angle and in contact with the flat surface for maintaining the vertical member upright, and the support member affixed to the upper end of the vertical member and disposed essentially in the same plane as the base member, the support member being provided with upwardly extending hook members disposed transversely to the support member and adapted to receive the upper edge portion of the book.

BRIEF DESCRIPTION OF THE DRAWINGS

In order that the invention may be more fully understood, it will now be described by way of example, with reference to the accompanying drawing in which:

FIG. 4 is an exploded view of the display rack showing all of the components required for assembly thereof;

FIG. 5 is a side view in elevation, partially broken away, of the display rack without the display books disposed thereon; and FIG. 6 is a top plan view of the display rack.

DESCRIPTION OF THE PREFERRED EMBODIMENT

Figure 3:
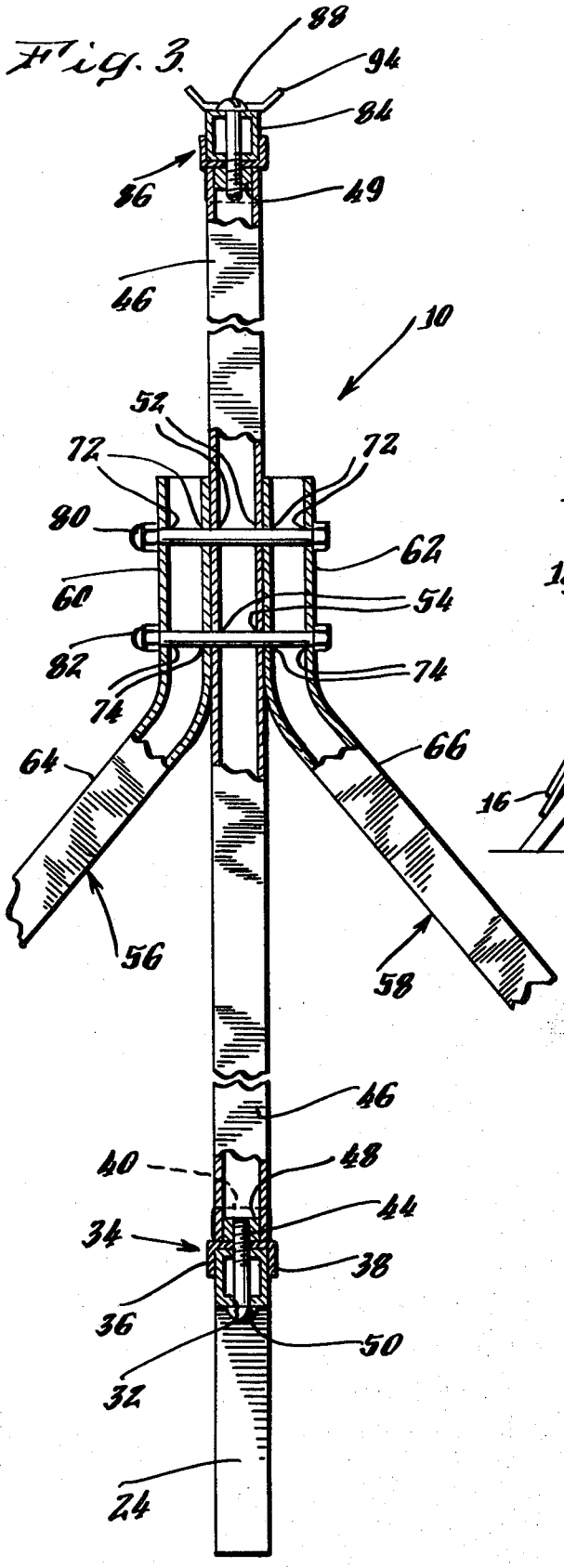
FIG. 3 is an enlarged view, partially broken away, showing the assembly of the various parts of the display rack.
Figure 2:
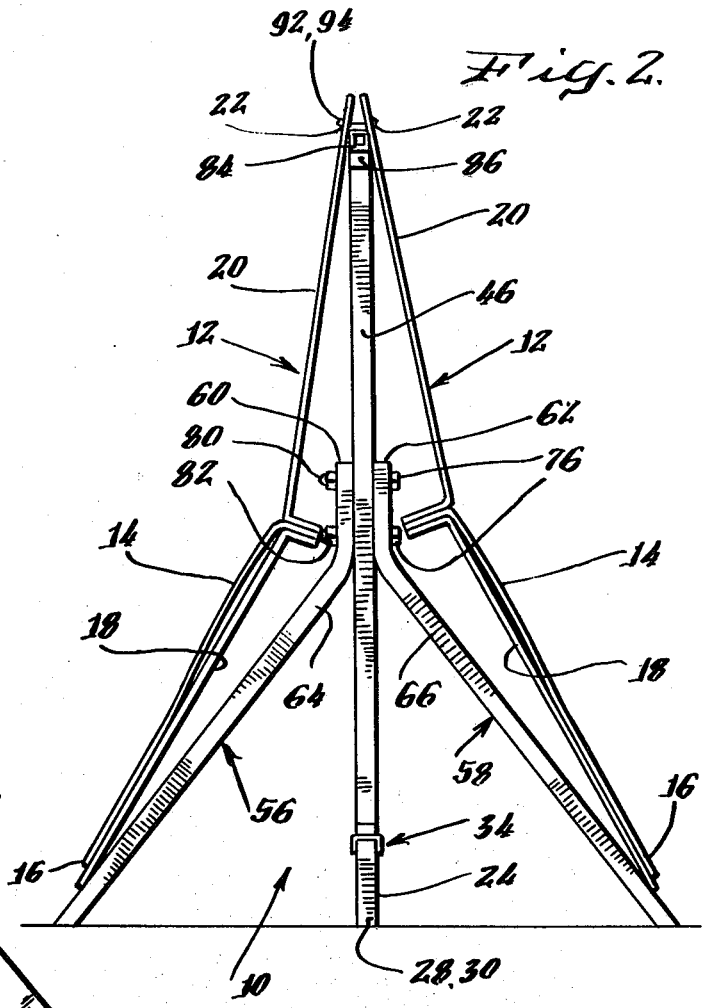
FIG. 2 is a side view in elevation of the display rack having disposed thereon two opened display books which may be readily viewed by an observer.
Figure 1:
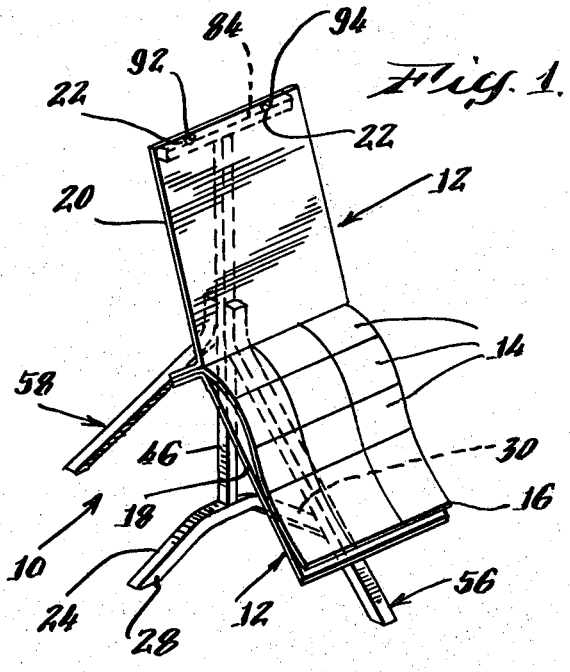
FIG. 1 is a pictorial representation of a display rack according to the principles of the present invention having thereon a single book opened for display of the contents therein.

Referring now to the FIGS. 1 through 6 there is shown a display stand or rack 10 having disposed thereon a book member 12. The book member 12 includes a plurality of carpet samples 14 assembled to form a plurality of leaves 16 which are bound in the book 12 in a conventional manner. The book 12 includes a lower portion 18 and an upper portion 20. The upper and lower portions of book 12 are formed of thick semi-rigid material and function as the covers for the book 12. The upper portion 20 of book 12 is provided with a pair of apertures 22 proximate the edge opposite to the binding thereof. The use of these apertures will be explained hereinafter.

The display stand includes a generally U-shaped base member 24 disposed with the open end of the U in a downwardly direction for contact with a flat surface such as a floor 26. The edges 28 and 30 may be cut at an angle in order to have the U-shaped base member 24 flush with the floor 26 upon which it is to be mounted. Alternatively, resilient cup members, not shown, may be inserted over edges 28 and 30 to provide a non-marring surface for contact with the floor 26. Preferably the U-shaped base member and other elements described hereinafter are fabricated from rectangularly-shaped tubular stock which may be pre-cut and formed at the factory. Centrally disposed on the closed portion of the U-shaped base member is an aperture 32 (FIG. 4). A stabilizer bracket 34 has a pair of opposed flanges 36 and 38 extending in a downwardly direction, a pair of opposed flanges 40 and 42 extending in an upwardly direction, is also provided with a centrally disposed aperture 44, and provides support and stabilization of the vertical member 46. Vertical member 46 is also preferably fabricated from rectangularly-shaped tubular stock and has welded at each end, in a conventional manner, a pair of retaining nuts 48 and 49. A bolt 50 is adapted to be received by aperture 32 in base member 24 and aperture 44 in bracket 34 wherein it threadedly engages nut 48. Thus, upon tightening bolt 50 into the nut 48 the vertical member will be pulled downwardly towards base member 24 and will be rigidly retained by the stabilizer bracket 34, since the downwardly extending flanges 36 and 38 and the upwardly extending flanges 40 and 42 prevent any lateral movement between the vertical member 46 and the base member 24. The vertical member 46 is provided with a pair of centrally disposed apertures 52 and 54 approximately midway between both ends thereof.

A pair of leg members 56 and 58 are provided with flat portions 60 and 62 forming an obtuse angle with the remaining portions 64 and 66, respectively, of legs 56 and 58. Portions 64 and 66 extend in a downwardly direction towards the floor 26 with the edge portions 68 and 70 adapted to come in flush contact therewith. Resilient cup members, not shown, may also be added to edges 68 and 70 to form non-marring contacts with the floor surface.

The flat portions 60 and 62 of leg members 56 and 58 are provided with a pair of apertures 72 and 74 which are adapted to cooperate with and be in-line with apertures 52 and 54 provided in vertical member 46. Bolts 76 and 78 inserted through apertures 52, 72 and 54, 74 which threadedly engage cap nuts 80 and 82, respectively, retain legs 56 and 58 rigidly to vertical member 46 and thus, form a plane which is essentially at right angles to the plane formed by base member 24. The legs and base member forming two planes at 90° insure that the stand is stable and form flush contact with the floor 26.

A rectangularly-shaped tubular support member 84 is adapted to be affixed to vertical member 46 with the aid of a second stabilizer bracket 86, which is identical to stabilizer bracket 34, and bolt 88. The bolt 88 is adapted to be received by aperture 90, centrally disposed midway between the ends of support member 84; the aperture in stabilizer bracket 86, and it threadedly engages nut 49, disposed in the end of vertical member 46. The support member 84 is further provided with upwardly extending hook members 92 and 94 which are disposed transversely to the support member 84 and are located proximate each end thereof. The support member 84 when affixed to vertical member 46 is aligned in the same plane formed by the base member 24 and the vertical member 46.

The apertures 22 provided in the upper portion 20 of the book 12 are adapted to be received by the hook members 92 and 94 and the lower portion 18 of the book 12 is adapted to rest on the sloped remaining portions 64 and 66 of the leg members 56 and 58, thereby reducing the strain placed on apertures 22. Thus, the leaves 16 of the book 12 may be readily viewed by an observer enabling them to make a selection as to the type and color of carpeting desired.

It is apparent from the structure and number of elements in the present display stand that it may be readily assembled by a user thereof. The steps for assembling the display stand would be performed generally as follows:

Step 1. Bolt 50 is inserted through aperture 32 of base member 24 and aperture 44 in stabilizer bracket 34 to threadedly engage nut 48 retained in the vertical member 46. The downwardly extending flanges 36 and 38 will overlap the sides of base member 24. Upwardly extending flanges 40 and 42 overlap the sides of vertical member 46, thus preventing any rotation or relative movement between base member 24 and vertical member 46.

Step 2. Bolt 88 is inserted through aperture 90 in support member 84 and the aperture provided in the stabilizer bracket 86 where it threadedly engages nut 49 retained in vertical member 46. The downwardly extending flanges of stabilizer bracket 86 will overlap the sides of vertical member 46. The upwardly extending flanges of stabilizer bracket 86 will overlap the sides of support member 84 thus, preventing any rotation of the support member relative to the vertical member.

Step 3. Bolts 76 are inserted through apertures 72 and 74 of leg member 66, apertures 52 and 54 of the vertical member 46 and apertures 72 and 74 of leg member 56 where they are to threadedly engage cap nuts 80. Legs 56 and 58 are positioned to extend outwardly from the vertical member reaching a flat surface together with the edges 28 and 30 of base member 24.

The display stand is now complete. Resilient plastic or rubber cups or inserts may be inserted onto or within the ends of base member 24, leg members 56 and 58 and support member 84, if so desired.

Hereinbefore has been disclosed a simple rugged display rack for displaying samples of carpet bound in a book format. It will be understood that various changes in the details, materials, arrangement of parts and assembly method which has been herein described and illustrated in order to explain the nature of the invention may be made by those skilled in the art within the principles and scope of the present invention.

Having thus set forth the nature of the invention, what is claimed is:

1. A display stand for displaying samples of carpet bound in a book means, said book means having an upper edge, comprising:

a. a generally U-shaped base member having its open end disposed in a downwardly direction for contact with a flat surface;

b. a vertical member having its lower end affixed to the central portion of said U-shaped base member;

c. a pair of leg members affixed to said vertical member and extending outwardly therefrom in a plane intersecting the plane formed by said vertical member and said base member at essentially a right angle and in contact with said flat surface for maintaining said vertical member upright, each of said leg members including a first portion affixed to said vertical member intermediate the ends of said vertical member, each of said leg members further including a second portion, disposed at an angle to said first portion, for supporting a portion of said book means, each of said second portions flaring away from said vertical member to said flat surface; and d. a horizontal support member affixed to the upper end of said vertical member and disposed essentially in the same place as said base member, said horizontal support member having a length approximately equal to that of the upper edge of said book means, said support member being provided with upwardly extending spaced apart hook members disposed transversely to said support member and adapted to receive the upper edge portion of said book.

2. A display stand according to claim 1 wherein each said leg member forms an acute angle with said vertical member for supporting the lower portion of a display book placed thereon.

3. A display stand according to claim 1 wherein said base member, said vertical member, said leg members and said support member are fabricated as separate pieces, further including a pair of stabilizer brackets having an opposed pair of flanges extending upwardly and an opposed pair of flanges extending downwardly, one said stabilizer brackets being disposed between said base member and said vertical member, the other of said stabilizer brackets being disposed between said vertical member and said support member, and bolts all of which are to be assembled by the user thereof.

4. A display stand according to claim 3 wherein said base member, said vertical member, said leg members, and said support member are rectangularly-shaped tubing.

5. A display stand according to claim 3 wherein only four bolts and two nuts are required to assemble the complete unit.

6. A display stand kit for displaying samples of carpet bound in a book means and adapted to support the lower portion of said book means when opened, said book means including an upper edge portion, comprising:

a. a tubular U-shaped base member having an aperture centrally disposed between its ends;

b. a vertical member having a threaded portion at each end thereof and being provided with a pair of apertures therethrough, said apertures being disposed intermediate the ends of said vertical member;

c. a pair of leg members each having a first portion with a pair of apertures therein and a second portion forming an obtuse angle with said first portion thereof;

d. a horizontal support member having a pair of upwardly extending spaced apart hook members disposed proximate each end thereof and transverse therewith, said horizontal support member being provided with a centrally disposed aperture, said horizontal support member being disposed essentially in the same plane as said base member, said horizontal support member having a length approximately equal to that of the upper edge of said book means;

e. a pair of stabilizer brackets, each having a pair of opposed flanges extending upwardly and a pair of opposed flanges extending downwardly and being provided with a centrally disposed aperture; and f. a plurality of bolts and nuts:

whereby one bolt passing through said base member aperture and the aperture of a stabilizer bracket disposed on top of said base member may threadedly engage one end of said vertical member, a second bolt passing through said support member aperture and the aperture of another stabilizer bracket disposed below said support member may threadedly engage the other end of said vertical member, said pairs of leg member apertures being placed on either side of the pair of apertures provided in said vertical member with the second portions thereof extending away from said base member and the first portions of said leg members being retained thereat by the remaining bolts passing through said pairs of apertures and being threadedly engaged with the remaining nuts.

7. A display stand kit according to claim 6 wherein said base member, said vertical member, said pair of leg members and said support member are rectangularly-shaped tubing.

8. A display stand kit according to claim 6 which includes four bolts and two nuts.

* * * * *